US009581386B2

(12) United States Patent
Davidian

(10) Patent No.: US 9,581,386 B2
(45) Date of Patent: Feb. 28, 2017

(54) APPARATUS AND PROCESS FOR SEPARATING AIR BY CRYOGENIC DISTILLATION

(75) Inventor: Benoit Davidian, Houston, TX (US)

(73) Assignee: L'Air Liquide Société Anonyme Pour L'Étude Et L'Exploitation Des Products Georges Claude, Paris (FR)

( * ) Notice: Subject to any disclaimer, the term of this patent is extended or adjusted under 35 U.S.C. 154(b) by 718 days.

(21) Appl. No.: 13/805,367

(22) PCT Filed: Jul. 5, 2011

(86) PCT No.: PCT/EP2011/061279
§ 371 (c)(1),
(2), (4) Date: Feb. 13, 2013

(87) PCT Pub. No.: WO2012/004242
PCT Pub. Date: Jan. 12, 2012

(65) Prior Publication Data

US 2013/0133364 A1 May 30, 2013

(30) Foreign Application Priority Data

Jul. 5, 2010 (FR) ..... 10 55421
Jul. 5, 2010 (FR) ..... 10 55423

(51) Int. Cl.
*F25J 3/04* (2006.01)
*F25J 3/02* (2006.01)

(52) U.S. Cl.
CPC ..... *F25J 3/04* (2013.01); *F25J 3/0204* (2013.01); *F25J 3/0409* (2013.01); *F25J 3/0486* (2013.01);
(Continued)

(58) Field of Classification Search
CPC .... F25J 3/04812; F25J 3/04818; F25J 3/0483; F25J 3/04842; F25J 3/04848;
(Continued)

(56) References Cited

U.S. PATENT DOCUMENTS 5,408,831 A * 4/1995 Guillard ..... F25J 3/0409 62/647
5,505,052 A * 4/1996 Ekins ..... C21C 7/0685 62/643
(Continued)

FOREIGN PATENT DOCUMENTS

| | | |
|---|---|---|
| EP | 0605262 | 7/1994 |
| EP | 1202012 | 5/2002 |
| WO | WO 2010017968 | 2/2010 |

OTHER PUBLICATIONS

FR 1055423, French Search Report, Apr. 13, 2011.
Petras et al., "Oxygen Plants for Coal Gasification: Experience at the Cool Water GCC Power Plant," Publication BOC Cryoplants, BOC Cryoplants Engineering Centre (Sep. 1, 1987).

*Primary Examiner* — Frantz Jules
*Assistant Examiner* — Brian King
(74) *Attorney, Agent, or Firm* — Justin K. Murray

(57) ABSTRACT

In a process for delivering pressurized gas from an apparatus for separating air by cryogenic distillation, a stream of oxygen-rich liquid or gas having a nominal flow rate is withdrawn from a low-pressure column, an oxygen-rich liquid purge stream is withdrawn as bottoms from the low-pressure column and the oxygen-rich liquid purge stream is sent to a storage tank, in the event of a reduction in the production by the column system or an increase in the demand by a customer, a back-up stream is withdrawn from the storage tank and vaporized in a back-up reboiler and only if the liquid level in the storage tank exceeds a given threshold, a liquid stream is withdrawn from the storage tank
(Continued)

constituting at most 2% of the nominal production output of the oxygen-rich stream and is sent to the back-up reboiler.

9 Claims, 2 Drawing Sheets

(52) U.S. Cl.
CPC ..... *F25J 3/04206* (2013.01); *F25J 3/04303* (2013.01); *F25J 3/04412* (2013.01); *F25J 3/04824* (2013.01); *F25J 3/04836* (2013.01); *F25J 2215/02* (2013.01); *F25J 2215/54* (2013.01); *F25J 2245/50* (2013.01); *F25J 2250/50* (2013.01); *F25J 2290/62* (2013.01)

(58) Field of Classification Search
CPC .. F25J 2215/54; F25J 2290/62; F25J 2245/50; F25J 2250/50; F25J 2215/02; F25J 3/04; F25J 3/0409; F25J 3/04206
USPC ..... 62/620
See application file for complete search history.

(56) References Cited

U.S. PATENT DOCUMENTS

| | | | | |
|---|---|---|---|---|
| 5,566,556 | A | 10/1996 | Ekins et al. | |
| 6,062,044 | A * | 5/2000 | Bernard | F25J 3/0409 62/647 |
| 6,182,471 | B1 * | 2/2001 | Meagher | 62/646 |
| 6,345,517 | B1 * | 2/2002 | Jahnke | 62/643 |
| 6,351,968 | B1 * | 3/2002 | Habicht | F25J 3/04412 62/643 |
| 6,418,753 | B1 * | 7/2002 | Voit | F25J 3/0409 62/643 |
| 6,871,513 | B2 | 3/2005 | Guillard | |
| 2006/0010909 | A1 | 1/2006 | Briglia et al. | |
| 2007/0101763 | A1 * | 5/2007 | Garnier | F17C 5/06 62/620 |
| 2011/0214453 | A1 | 9/2011 | Alekseev | |

* cited by examiner

APPARATUS AND PROCESS FOR SEPARATING AIR BY CRYOGENIC DISTILLATION

CROSS REFERENCE TO RELATED APPLICATIONS

This application is a §371 of International PCT Application PCT/EP2011/061279, filed Jul. 5, 2011, which claims the benefit of FR1055421 and FR1055423, both filed Jul. 5, 2010, all of which are herein incorporated by reference in their entireties.

TECHNICAL FIELD OF THE INVENTION

The present invention relates to an apparatus and to a process for separating air by cryogenic distillation.

BACKGROUND

In these apparatuses, it is necessary to take off a purge stream permanently from the external evaporators used to evaporate the liquid oxygen at low pressure and/or from evaporators within the columns, in order to avoid a potentially dangerous accumulation of impurities. These purge streams are withdrawn substantially permanently, for example, from the bottom of a low-pressure column, which produces only gaseous oxygen withdrawn directly from that column, in order to prevent the accumulation of impurities.

The purge of the cryogenic liquids from the cold box are generally sent to a specific device for evaporating them:

- gravel pit, for generators of very small size
- atmospheric chamber, which collects the liquids, which will subsequently evaporate slowly
- evaporator (using heating and ventilation).

In EP-A-0605262, a purge liquid is sent into a storage facility, and a liquid portion from the storage facility is sent into a heat exchanger to be mixed with gaseous oxygen. The storage facility is also fed by liquid transported by a truck; the system is therefore one of injection of liquid oxygen with an extra contribution of external liquid, thus allowing the purge to be evaporated with the reheated gaseous oxygen.

In EP-A-1202012, a storage facility is fed by a purge stream originating from the bottom of the low-pressure column in the case of a reduction in the production of the column system, a standby stream which is evaporated in a standby evaporator is withdrawn from the storage facility.

SUMMARY OF THE INVENTION

According to the invention, the purge is able to compensate the evaporation losses in the storage facility, and the excess is evaporated in the standby vaporization system (without recovery of the refrigeration capacities in the cold box).

According to the invention, provision is made to send a purge stream to a liquid oxygen storage facility, optionally by means of a pump, depending on its pressure.

According to one subject of the invention, a process is provided for separating air by cryogenic distillation, to give a gaseous product, optionally under pressure, wherein a) cooled, purified, and compressed air is sent into a column system comprising a medium-pressure column and a low-pressure column b) i) from the low-pressure column, an oxygen-rich gas stream is withdrawn which has a nominal flow, to form a gaseous product, and an oxygen-rich liquid purge stream is withdrawn at the bottom of the low-pressure column, the purge stream being richer in oxygen and in heavy impurities than the stream having the nominal flow and constituting not more than 2% of the nominal production flow of the oxygen-rich stream, or ii) from the low-pressure column, an oxygen-rich liquid stream is withdrawn which has a nominal flow, and is evaporated in a main evaporator, to form a gaseous product, and an oxygen-rich liquid purge stream is withdrawn which constitutes not more than 2% of the nominal production flow of the oxygen-rich stream from the evaporator, c) the oxygen-rich liquid purge stream is sent into a storage facility, d) if the level of liquid in the storage facility exceeds a threshold corresponding to the maximum capacity of the storage facility, a liquid stream is withdrawn from the storage facility, constituting not more than 2% of the nominal production flow of the oxygen-rich stream, and is sent to the standby evaporator, to make up part of the gaseous product, and e) if the level of liquid in the storage facility is below the threshold, the liquid purge stream is sent to the storage facility, but the liquid is sent from the storage facility to the standby evaporator only in the case of a reduction in production by the column system or of an increase in demand by a customer for the gaseous product.

According to other, optional subjects:

- the oxygen-rich liquid purge stream is sent from the bottom of the low-pressure column or from the evaporator into the storage facility permanently or occasionally, outside of periods of shutdown and startup of the column system.
- in the case of shutdown of the column system, the purge stream is not sent to the storage facility.
- the stream having a nominal flow is a gas stream withdrawn from the low-pressure column, and the purge stream constitutes the only oxygen-rich stream withdrawn from the column system.
- during shutdown of the column system, the storage facility is filled by means of liquid coming from the bottom of at least one column of the column system.
- from the low-pressure column, an oxygen-rich gas stream is withdrawn which has a nominal flow, to form a gaseous product, and an oxygen-rich liquid purge stream is withdrawn at the bottom of the low-pressure column, the purge stream being richer in oxygen and in heavy impurities than the stream having the nominal flow and constituting not more than 2% of the nominal production flow of the oxygen-rich stream.
- from the low-pressure column, an oxygen-rich liquid stream is withdrawn which has a nominal flow, and is evaporated in a main evaporator to form a gaseous product, and an oxygen-rich liquid purge stream constituting not more than 2% of the nominal production flow of the oxygen-rich stream is withdrawn from the evaporator.
- the sending of liquid from the storage facility to the standby evaporator is always initiated if the threshold in the storage facility is exceeded
- if the threshold in the storage facility has not been reached, the sending of liquid from the storage facility to the standby evaporator is initiated only in the case of an increase in the customer's demands or in the case of a reduction in production by the column system.

The standby evaporator therefore has a function of evaporating the overflow in the storage facility.

According to another subject of the invention, an apparatus is provided for separating air by cryogenic distillation, comprising a column system comprising a medium-pressure column and a low-pressure column, a storage facility, a standby evaporator, and either i) means for withdrawing, from the low-pressure column, an oxygen-rich gas stream having a nominal flow, to form a gaseous product, and means for withdrawing an oxygen-rich liquid purge stream at the bottom of the low-pressure column, the purge stream being richer in oxygen and in heavy impurities than the stream having the nominal flow and constituting not more than 2% of the nominal production flow of the oxygen-rich stream, or ii) a main evaporator, means for withdrawing, from the low-pressure column, an oxygen-rich liquid stream having a nominal flow, and for sending it to the main evaporator, means for withdrawing a gaseous product formed by evaporation of the liquid stream, means for withdrawing an oxygen-rich liquid purge stream constituting not more than 2% of the nominal production flow of the oxygen-rich stream from the evaporator, and means for sending the oxygen-rich liquid purge steam to the storage facility, detection and control means for detecting the level of liquid in the storage facility and for initiating, only if the level exceeds a threshold corresponding to the maximum capacity, the withdrawal of a liquid stream from the storage facility, constituting not more than 2% of the nominal production flow of the oxygen-rich stream, and the sending of this stream to the standby evaporator to constitute part of the gaseous product, these detection and control means being able to detect if the level of the liquid in the storage facility is below the threshold and, in that case, for initiating the sending of the liquid purge stream to the storage facility and the prevention of the sending of the liquid from the storage facility to the standby evaporator except in the case of a reduction in production by the column system or of an increase in demand by a customer for the gaseous product.

According to other, optional subjects:

the apparatus does not comprise a means for evaporating purge liquid apart from the standby evaporator.

the apparatus comprises means for withdrawing, from the low-pressure column, an oxygen-rich gas stream having a nominal flow, to form a gaseous product, and means for withdrawing an oxygen-rich liquid purge stream at the bottom of the low-pressure column, the purge stream being richer in oxygen and in heavy impurities than the stream having the nominal flow and constituting not more than 2% of the nominal production flow of the oxygen-rich stream.

the apparatus comprises a main evaporator, means for withdrawing, from the low-pressure column, an oxygen-rich liquid stream having a nominal flow and for sending it to the main evaporator, means for withdrawing a gaseous product formed by evaporating the liquid stream, and means for withdrawing an oxygen-rich liquid purge stream constituting not more than 2% of the nominal production flow of the oxygen-rich stream from the evaporator.

means for supplying the storage facility with a liquid from an external source.

means for sending a bottom liquid from the low-pressure column to the storage facility.

means for sending a bottom liquid from the medium-pressure column to the storage facility.

It will be noted that the transfer pump may also be the same one used for the transfer of the production of liquid oxygen, where appropriate.

The liquid oxygen storage facility is filled with oxygen of "industrial merchant" grade, which is therefore "pure" (99.5 mol %). In order to supply the customer when the air separation apparatus is not operating, provision is made to evaporate the liquid from this storage facility in a standby evaporator. Sending a purge liquid having an average purity less than that of the liquid from the storage facility will reduce slightly the purity of liquid contained in the storage facility, which will nevertheless be at an average level greater than the customer demand.

An oxygen-rich stream—gaseous or liquid—contains at least 75 mol % of oxygen.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

The invention will be described in more detail with reference to the figures, which illustrate an apparatus in accordance with various embodiments of the invention.

Figure 1:
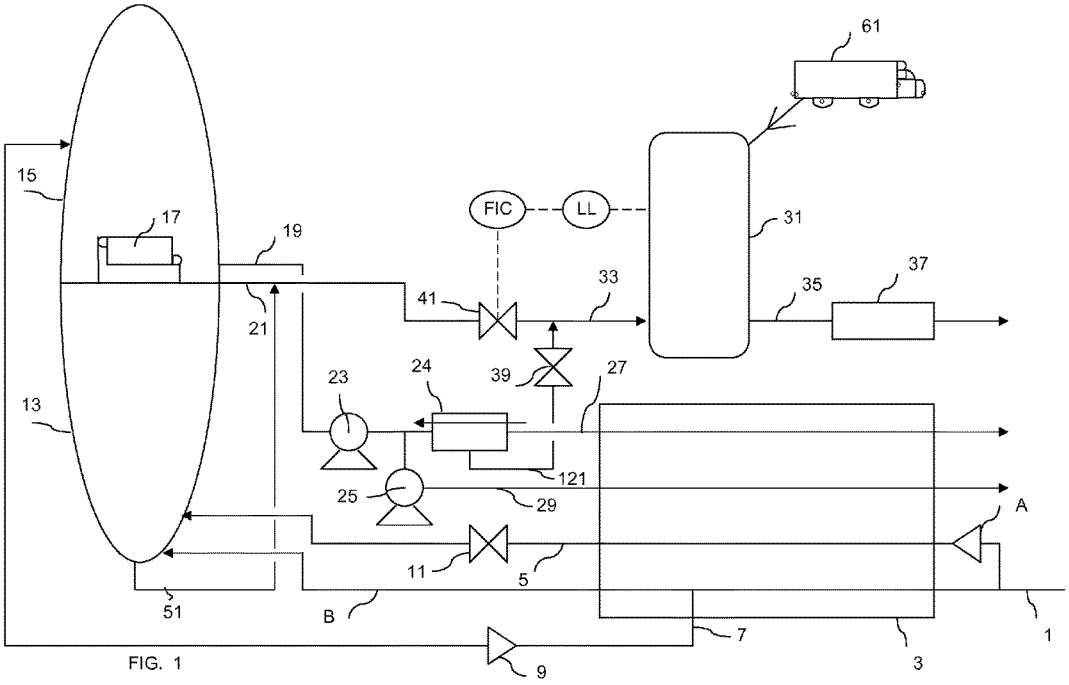
FIG. 1 represents an apparatus in accordance with an embodiment of the invention.

In FIG. 1, a stream of compressed and purified air 1 is cooled in a heat exchanger 3 and divided into three. A stream 7 is withdrawn from the heat exchanger at an intermediate level, released into a turbine 9, and sent to a low-pressure column 15 of a twin column, in gaseous form. Another stream 5, after having been compressed in the compressor A, is liquefied in the heat exchanger 3, released into a valve 11, and sent to the medium-pressure column 13. A third stream B is sent directly into the medium-pressure column.

Streams enriched in nitrogen and in oxygen are sent from the medium-pressure column to the low-pressure column in a conventional manner. At the bottom of the low-pressure column 15, liquid oxygen accumulates around the reboiler 17. A liquid oxygen stream 19 containing less than 98% oxygen is withdrawn from the bottom of the low-pressure column 15 and pressurized by a pump 23 to 2 bar; alternatively, the compression may be hydrostatic. A portion of the oxygen at this pressure is sent to an evaporator 24, where it evaporates by heat exchange with a portion of the feed air (5 or B) which is then sent to the column. This evaporated stream constitutes the gas production of the column system in normal operation, and is produced with a nominal flow.

A purge stream 121 containing impurities is withdrawn from the evaporator 24 permanently, unless the column system is not operating. This stream is purer in oxygen than the stream 19. The evaporated oxygen continues its reheating in the heat exchanger 3, as low-pressure oxygen stream 27.

The remainder of the oxygen is pressurized to a pressure of 10 bar in a pump 25, and evaporates in the heat exchanger 3 as stream 29. Alternatively, all of the oxygen may be evaporated to the lower pressure, and the stream 29 will not exist.

A first line connects the evaporator 24 to the storage facility 31, for conveying the purge liquid 121 to said facility permanently or occasionally, unless the column system is not operating. The storage facility 31 supplies a standby evaporator 37 with liquid oxygen 35. The purge liquid may be sent occasionally, which means that the liquid is withdrawn from the evaporator periodically, according to a cycle, so as to have quantities of liquid that allow proper analysis.

Oxygen is evaporated in the standby evaporator 37 in large quantity, when the customer demands are particularly high or when the air separation apparatus is not operating at full capacity, in the case of breakdown, for example.

In contrast, during periods in which the customer demands are not particularly high and the air separation apparatus is operating normally, an oxygen-rich liquid stream constituting less than 2% of the nominal flow of gaseous oxygen 19, and preferably around 1% of the nominal flow, is sent to the storage facility. This liquid stream is sent to the standby evaporator only if the level in the storage facility exceeds a threshold, this threshold typically being that of the maximum capacity of the storage facility 31. Accordingly, this stream sent to the standby evaporator constitutes the overflow of the storage facility 31. The evaporated oxygen is sent to the customer.

This allows recovery of the molecules of the purge in the liquid 121, and therefore allows a reduction in the total production of the apparatus (maximum energy gain of around 1% to 2%).

If the level in the storage facility 31 is below the threshold, more particularly when the storage facility is not full, the storage facility 31 is filled by sending the liquid 121 to it.

The majority of the liquid in the storage facility originates from a tanker truck 61 or from the apparatus itself via the stream 21, which can be diverted to the storage facility as and when required. The liquid in the storage facility originating from the truck has a purity of 99.5 mol %. The liquid 121 may be purer, as pure, or less pure than the liquid from the tanker truck 61.

Sending this pure liquid 121 to the storage facility 31 via the line 33 carries no risk of affecting the purity of the liquid in the storage facility.

On the other hand, consideration may be given to sending, in the case of column shutdown, the liquids accumulated in the bottom of the low-pressure and/or medium-pressure column to the storage facility as well, in the lines 21 and 51. These liquids will obviously have a purity lower than that of the liquid from the truck 61 or that of the liquid 121. In certain cases, the customer may tolerate, for the short term, a reduction in purity of the liquid evaporated in the standby evaporator. A valve 41 allows regulation of the flows of these accumulated liquids that are sent to the storage facility 31.

Figure 2:
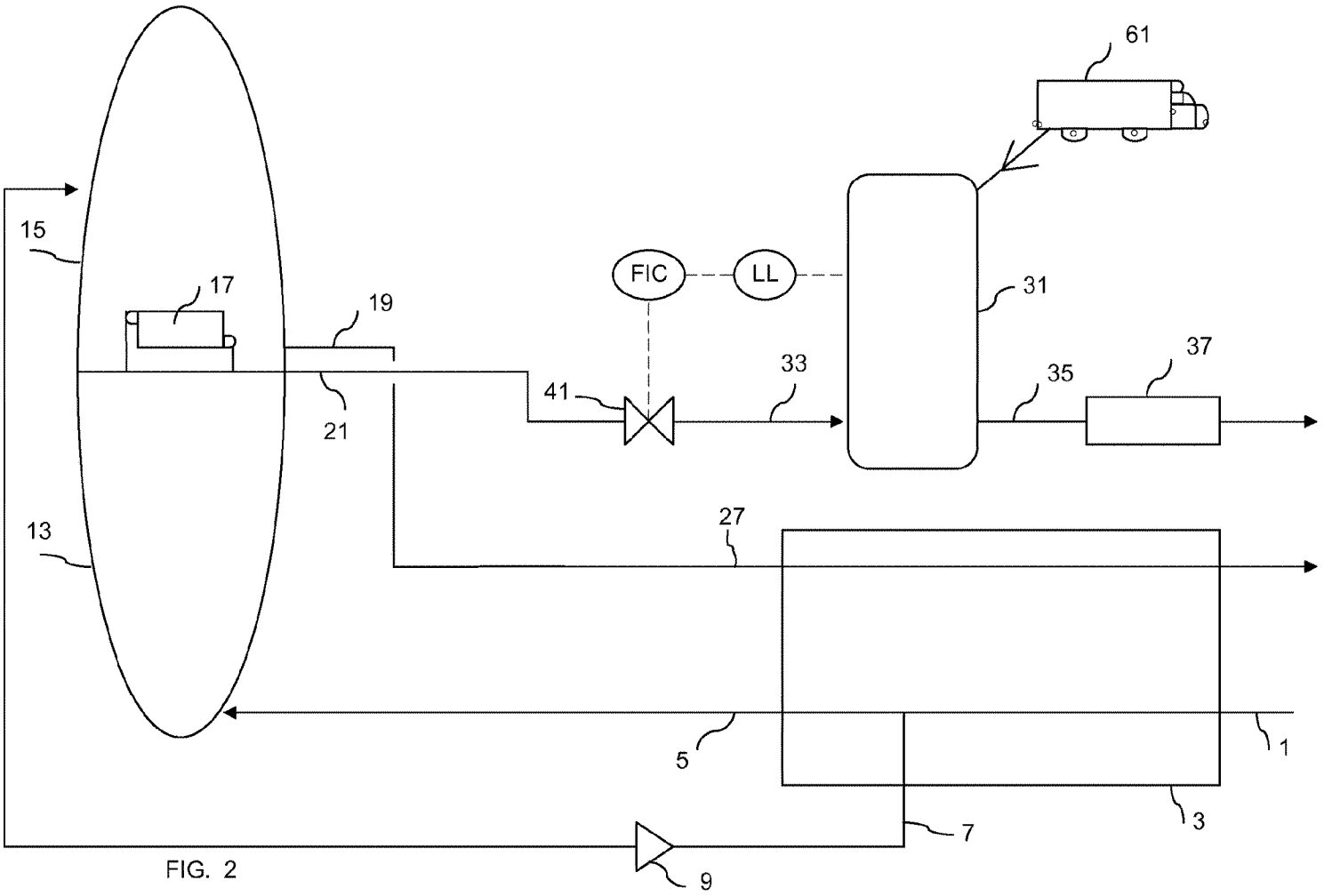
FIG. 2 represents an apparatus in accordance with an embodiment of the invention.

In FIG. 2, a stream of compressed and purified air 1 is cooled in a heat exchanger 3 and divided into two. A stream 7 is withdrawn from the heat exchanger at an intermediate level, released into a turbine 9, and sent to a low-pressure column 13 of a twin column, in gaseous form. Another stream, 5, is cooled in the heat exchanger 3 and sent to the medium-pressure column 13.

Streams enriched in nitrogen and in oxygen are sent from the medium-pressure column to the low-pressure column in a conventional manner. At the bottom of the low-pressure column 15, liquid oxygen accumulates around the reboiler 17. A gaseous oxygen stream 19 containing approximately 98% oxygen is withdrawn from the bottom of the low-pressure column 15 and is reheated in the heat exchanger 3 as low-pressure oxygen stream 27, before undergoing optional compression (not shown). A purge stream 21 containing impurities is withdrawn from the bottom of the column 15 permanently, to prevent accumulation of impurities in the column bottom. This liquid withdrawal constitutes the only oxygen-rich withdrawal from the column system. A first line connects the column bottom BP to the storage facility 31, in order to carry the purge liquid 21 to the facility permanently (either continuously or in regular batches), unless the column system is not operating. The storage facility 31 supplies a standby evaporator 37 with the liquid oxygen 35.

The oxygen is evaporated in the standby evaporator 37 in large quantity, when customer demands are particularly high or when the air separation apparatus is not operating at full capacity, in the case of breakdown, for example.

In contrast, during periods when the customer demands are not particularly high and the air separation apparatus is operating normally, an oxygen-rich liquid stream constituting less than 2% of the nominal flow of gaseous oxygen 19, and preferably approximately 1% of the nominal flow, is sent to the storage facility. This liquid stream is sent to the standby evaporator if the level in the storage facility exceeds a threshold, this threshold typically being that of the maximum capacity of the storage facility 31. Accordingly, this stream sent to the standby evaporator constitutes the overflow of the storage facility 31. The evaporated oxygen is sent to the customer.

This allows recovery of the molecules of the purge in the liquid 21, and therefore a reduction in the total production of the apparatus (maximum energy gain of around 1% to 2%).

If the level in the storage facility 31 is below the threshold, more particularly when the storage facility is not full, the storage facility 31 is filled by sending the liquid 21 to it. In normal operation, therefore, the liquid from the storage facility is not sent to the standby evaporator if the maximum level is not reached. However, initiation of sending from the storage facility to the standby evaporator may be necessary, in the case of a reduction in production by the column system or of an increase in the customer's demands.

The purge stream 21 has a higher molar oxygen purity than that of the stream 19.

The majority of the liquid in the storage facility comes from a tanker truck 61 or from the apparatus itself via a liquid stream which is taken off as and when necessary (not shown), which can be sent to the storage facility. The liquid in the storage facility from the truck has a purity of 99.5 mol %. A pump may be needed in order to send the purge liquid 21 to the storage facility.

The purge stream 21 may be purer, as pure, or less pure than the liquid supplying the storage facility from the tanker truck 61, for example.

The liquid in the storage facility 31 may be evaporated in a standby evaporator 37 and sent to a customer in the event of breakdown of the distillation apparatus and/or if the production level of the distillation apparatus is insufficient for supplying the customer.

In the possible event of the column system shutting down, consideration may be given to sending the liquids accumulated in the column bottoms during shutdown to the storage facility 31 likewise. In the case of FIG. 2, the system comprises a low-pressure column and a medium-pressure column; however, it will be readily appreciated that the invention also applies to the case in which the accumulated liquids sent to the storage facility may come from an argon column, an intermediate-pressure column or a mixing column. This withdrawal of an accumulated liquid during shutdown of an argon column, an intermediate-pressure column, or a mixing column also applies to the case of FIG. 1.

In the event these impure liquids are sent from the column bottoms to the storage facility during shutdown of a column, it is sometimes necessary to regulate the sending of liquid to the storage facility as a function of the level of liquid in the storage facility. Such regulation is unnecessary when the liquids sent to the storage facility are only high-purity permanent purge liquids.

In one embodiment, the essential requirement is to regulate the sending of high-purity purge liquid (or, optionally, of a mixture of high-purity purge liquid and less pure accumulated liquids) such that the liquid sent to the standby evaporator has a purity above a threshold which is acceptable for the customer.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary a range is expressed, it is to be understood that another embodiment is from the one.

Optional or optionally means that the subsequently described event or circumstances may or may not occur. The description includes instances where the event or circumstance occurs and instances where it does not occur.

Ranges may be expressed herein as from about one particular value, and/or to about another particular value. When such particular value and/or to the other particular value, along with all combinations within said range.

All references identified herein are each hereby incorporated by reference into this application in their entireties, as well as for the specific information for which each is cited.

The invention claimed is:

1. A process for separating air by cryogenic distillation to produce a gaseous product, the process comprising the steps of:

a) sending a cooled, purified, and compressed air into a column system comprising a medium-pressure column and a low-pressure column;

b) withdrawing from the low-pressure column, an oxygen-rich stream which has a nominal flow, and withdrawing an oxygen-rich liquid purge stream at the bottom of the low-pressure column, wherein the oxygen-rich liquid purge stream is richer in oxygen and in heavy impurities than the oxygen-rich stream, wherein the oxygen-rich liquid purge stream has a first flow rate that constitutes not more than 2% of the nominal production flow rate of the oxygen-rich stream, wherein the oxygen-rich stream comprises a fluid selected from the group consisting of an oxygen-rich liquid and an oxygen-rich gas, wherein if the fluid is the oxygen-rich gas, the oxygen-rich gas forms an oxygen-rich gaseous product, wherein if the fluid is the oxygen-rich liquid, the step further includes evaporating the oxygen-rich liquid stream in a main evaporator to form the oxygen-rich gaseous product;

c) sending the oxygen-rich liquid purge stream into a storage facility at the first flow rate; and d) providing a control system configured to control the level of liquid in the storage facility, wherein if the control system detects that the level of liquid in the storage facility exceeds a threshold corresponding to the maximum capacity of the storage facility, the control system is configured to initiate a withdrawal of a storage liquid stream from the storage facility at a second flow rate this is approximately equal to the first flow rate, and a sending of the storage liquid to a standby evaporator, to make up part of the oxygen-rich gaseous product, wherein if the control system detects that the level of liquid in the storage facility is below the threshold corresponding to the maximum capacity of the storage facility, the control system is configured to initiate continued sending of the oxygen-rich liquid purge stream to the storage facility at the first flow rate, while only sending the storage liquid stream from the storage facility to the standby evaporator in the case of a reduction in production of the oxygen-rich gaseous product by the column system or of an increase in demand by a customer for the oxygen-rich gaseous product.

2. The process as claimed in claim 1, wherein the oxygen-rich liquid purge stream is sent from the bottom of the low-pressure column or from the evaporator into the storage facility permanently or occasionally, outside of periods of shutdown and startup of the column system.

3. The process as claimed in claim 1, wherein, in the case of shutdown of the column system, the purge stream is not sent to the storage facility.

4. The process as claimed in claim 1, wherein the fluid is the oxygen-rich gas, and no other liquid streams are withdrawn from the column system aside from the oxygen-rich liquid purge stream.

5. The process as claimed in claim 1, wherein during shutdown of the column system, the storage facility is filled by means of a bottoms liquid coming from the bottom of at least one column of the column system.

6. The process as claimed in claim 1, wherein the fluid comprising the oxygen-rich stream is the oxygen-rich gas.

7. The process as claimed in claim 1, wherein the fluid comprising the oxygen-rich stream is the oxygen-rich liquid.

8. The process as claimed in claim 5, wherein the bottoms liquid comes from the bottom of the medium-pressure column.

9. A process for separating air by cryogenic distillation to produce a gaseous product, the process comprising the steps of:

a) sending a cooled, purified, and compressed air into a column system comprising to medium-pressure column and a low-pressure column;

b) providing a storage facility having liquid oxygen disposed therein, wherein at least some of the liquid oxygen disposed therein originated from a source external the column system;

c) withdrawing from the low-pressure column, an oxygen-rich stream which has a nominal flow, and withdrawing an oxygen-rich liquid purge stream at the bottom of the low-pressure column, wherein the oxygen-rich liquid purge stream is richer in oxygen and in heavy impurities than the oxygen-rich stream, wherein the oxygen-rich liquid purge stream has a first flow rate that constitutes between 1 to 2% of the nominal production flow rate of the oxygen-rich stream, wherein the oxygen-rich stream comprises a fluid selected from the group consisting of an oxygen-rich liquid and an oxygen-rich gas, wherein if the fluid is the oxygen-rich gas, the oxygen-rich gas forms an oxygen-rich gaseous product, wherein if the fluid is the oxygen-rich liquid, the step further includes evaporating the oxygen-rich liquid stream in a main evaporator to form the oxygen-rich gaseous product;

d) sending the oxygen-rich liquid purge stream into the storage facility at the first flow rate;

e) withdrawing a storage liquid from the storage facility at a second flow rate, evaporating the storage liquid in a standby evaporator, and combining the resulting evaporated storage liquid with the oxygen-rich gaseous product;

f) providing a control system configured to control the level of liquid in the storage facility by adjusting the second flow rate based upon the level of liquid in the storage facility, such that if level of liquid in the storage facility exceeds a threshold corresponding to the maximum capacity of the storage facility, the second flow rate is approximately equal to the first flow rate, and such that if the level of liquid in the storage facility is below the threshold corresponding to the maximum capacity of the storage facility, the second flow rate is zero unless there is a reduction in production of the oxygen rich gaseous product by the column system or there is an increase in demand by a customer for the oxygen rich gaseous product.

* * * * *